US005997253A

United States Patent [19]

Feehan

[11] Patent Number: 5,997,253

[45] Date of Patent: Dec. 7, 1999

[54] ADJUSTABLE PITCH PROPELLER

[75] Inventor: Richard J. Feehan, Fond du Lac, Wis.

[73] Assignee: Brunswick Corporation, Lake Forest, Ill.

[21] Appl. No.: 09/112,726

[22] Filed: Jul. 9, 1998

[51] Int. Cl.[6] ..... B63H 3/12

[52] U.S. Cl. ..... 416/207; 416/153; 416/205; 416/220 R; 416/220 A; 416/244 B

[58] Field of Search ..... 416/153, 205, 416/220 R, 220 A, 207, 244 B

[56] References Cited

U.S. PATENT DOCUMENTS

| | | | |
|---|---|---|---|
| 2,983,320 | 5/1961 | Uhrich et al. | 416/220 A |
| 3,255,827 | 6/1966 | Nichols | 416/207 |
| 4,150,921 | 4/1979 | Wennberg | 416/207 |
| 4,297,079 | 10/1981 | Marshall | 416/140 |
| 4,540,341 | 9/1985 | Wiiher | 416/157 |
| 4,929,201 | 5/1990 | Pitt | 440/50 |
| 4,973,225 | 11/1990 | Krupps | 416/157 |
| 5,017,090 | 5/1991 | Morrison | 416/168 |
| 5,022,820 | 6/1991 | Bergeron | 416/89 |
| 5,073,134 | 12/1991 | Muller | 440/50 |
| 5,226,844 | 7/1993 | Muller | 440/50 |
| 5,232,345 | 8/1993 | Rocco | 416/159 |
| 5,290,147 | 3/1994 | Karls | 416/34 |
| 5,445,497 | 8/1995 | Seemar | 416/131 |
| 5,527,153 | 6/1996 | Bernhardt | 416/46 |
| 5,611,665 | 3/1997 | Angel | 416/1 |
| 5,733,156 | 3/1998 | Aikara et al. | 440/49 |

*Primary Examiner*—F. Daniel Lopez
*Assistant Examiner*—Ninh Nguyen
*Attorney, Agent, or Firm*—William D. Lanyi

[57] ABSTRACT

An adjustable propeller is provided with a receptacle on its hub which is shaped to receive a base portion of a propeller blade. First and second pluralities of alignment devices are provided to allow an operator to select a desired pitch angle and attach the blades of the propeller to the hub so that the desired pitch angle is selected. Alignment devices can comprise a plurality of holes in each receptacle which are tapped to receive a bolt in threaded association therein. Associated holes in the base portion of the propeller can allow free passage of the bolt by selecting one of the holes in the base portion of the propeller and aligning that hole with an associated hole in the receptacle of the hub, an operator can quickly and easily select a desired pitch angle for the blade. A bolt passes through a hole in the base portion of the blade and threads into an associated hole in the propeller hub to select the pitch and attach the base portion to the hub.

17 Claims, 7 Drawing Sheets

ADJUSTABLE PITCH PROPELLER

BACKGROUND OF THE INVENTION

1. Field of the Invention

The present invention is generally related to an adjustable pitch propeller and, more particularly, to a propeller that comprises a hub portion to which a plurality of propeller blades can be attached in such a way that the pitch of the blades is manually selectable.

2. Description of the Prior Art

Those skilled in the art are familiar with many different types of variable pitch and adjustable pitch propellers. Some of these propellers are capable of automatically adjusting the pitch of the propeller blades while the propeller is rotating and providing the propulsion for a marine vessel. Other types of propellers are manually adjustable. In all types of variable pitch and adjustable pitch propellers, the relative positions of the propeller blades to the propeller hub can be changes, either automatically or manually.

U.S. Pat. No. 5,527,153, which issued to Bernhardt on Jun. 18, 1996, discloses a variable pitch propeller for a power boat. Three blades are mounted on a housing which is carried by the propeller shaft. Each blade has an axle received in the housing. Each axle has a slot receiving a dowel carried in the housing so the blade can rotate approximately 5° between two pitch positions. A centrifugally-operated, spring biased latch carried in the housing locks the shaft in each pitch position. The blade is released from the latch by a predetermined change in the hydrodynamic force acting on the blade surface. The propeller shaft is connected to the propeller assembly by three plastic keys which shear to permit the propeller assembly to spin with respect to the propeller shaft when the propeller assembly strikes a predetermined resistance, such as a rock or the like.

U.S. Pat. No. 5,445,497, which issued to Seemar on Aug. 29, 1995, describes variable pitch propellers. The variable pitch propeller is intended for use with a marine vessel and it includes a hub for mounting on a driven shaft. The hub has a plurality of blades which are mounted to bearing rings which are carried in recesses in the hub, with removable snap rings retaining the bearings therein with cap screws from the bosses extending to and engaged with the bearing rings for full rotation to automatic pitch positions and with cap screws which may extend into spaced holes in the hub for setting the blades to desired fixed positions.

U.S. Pat. No. 5,022,820, which issued to Bergeron on Jun. 11, 1991, discloses a variable pitch propeller which includes a central hub defining an axis of propeller rotation and a plurality of blades connected to and extending from the central hub. Each blade is mounted for rotation about a pitch axis. A cam mechanism is provided to translate centrifugal forces imposed on the blade into a force which tends to rotate the blade toward a course pitch. That force is opposed by water pressure tending to decrease the blade pitch. The cam mechanism includes a cam groove formed in an insert and made of a material that is harder than the blades. The propeller is provided with variable minimum and maximum pitch stops. A resilient bias is provided toward minimal blade pitch.

U.S. Pat. No. 5,232,345, which issued to Rocco on Aug. 3, 1993, describes a feathering propeller with a manually adjustable pitch. This device performs a pitch adjustment in a feathering propeller by employing a planet gear engagement between a pinion hub keyed on the driveshaft and planet pinions at the base of the blades of the propeller which are rotatably mounted through holes of the wall of the hub's casing. This is accomplished by registering the relative angular position of a second portion of the casing with respect to the first portion of a casing housing the planet gear. The registration of the pitch takes place by parting the second portion of the casing from the first portion against a resistance of a push-back spring for a distance sufficient to disengage a coupling between the second portion and first portion of a casing or the pinion hub, rotating the second portion to the point of disengagement with respect to the first portion of a casing before releasing the pull causing again the engagement of the two portions in a modified relative angular position. In this way, the stop mechanisms for the travel of a dragging sector solidly connected to the hub of a propeller, which are substantially formed on the internal wall of the second portion of the casing, change their relative position about the sector thus modifying the limit orientation assumed by the blades when the drive shaft is rotated. Resilient elements are used between abutment surfaces for preventing deformation thereof.

U.S. Pat. No. 5,290,147, which issued to Karls et al on Mar. 1, 1994, describes a variable pitch marine propeller with a shift biasing and synchronizing mechanism. The propeller includes a hub which is rotatable along a longitudinal axis and which has a plurality of blades extending radially outward therefrom. The blades are pivotable about respective radial pivot axes between a low pitch position and a high pitch position. A disc has a plurality of guide slots which each receive and retain a respective lever arm extending rearwardly within the hub from a respective blade. A biasing spring coaxial with the longitudinal axis of rotation of the hub biases the disc to bias the levers arms and blades to the low pitch position. The disc is a generally flat planer member extending radially outward from the longitudinal axis at the rear of the hub and includes a preload mechanism accessible at the rear of the hub for adjusting the bias. The disc restricts movement of the lever arms along the guide slots such that the lever arms can move only in unison, which prevents blade flutter. Pivoting of the blades is controlled by movement of the lever arms along the guide slots and arcuate movement of the guide slots as the disc rotates about the longitudinal axis, such that pivoting of each blade from its low pitch position to its high pitch position requires both a movement of the respective lever arm along its respective guide slot and rotation of the disc to arcuately move the guide slot.

U.S. Pat. No. 5,226,844, which issued to Muller on Jul. 13, 1993, describes an actuator for a variable pitch propeller. A drive for a boat is provided with a propeller hub which is rotatable about a main axis extending in a normal travel direction, a plurality of blades projecting generally radially of the main axis from the hub and each being pivotal so as to be of variable pitch. The respective blade rods extend axially and are displaceable axially relative to the hub in order to vary the pitch of the blades. The stator carried on the boat downstream in the direction from the hub and nonrotatable about the axis rotatably supports a cylinder housing that is releasably connected to the rods for joint axially movement therewith. A piston is displaceable along the axis in the cylinder and is releaseably connected to the hub for joint axial movement therewith. Pressurizable lines extend through the stator and are connected to the cylinder for alternately pressurizing the piston and thereby relatively axially shifting the rods and hub.

U.S. Pat. No. 5,073,134, which issued to Muller on Dec. 17, 1991, discloses a boat drive with an adjustable pitch propeller. The boat drive is of the type in which a housing outside of the hull of the board and below the water level receives a hollow propeller shaft driven by a drive shaft connected to the propeller shaft by a transmission. The hub of a variable pitch propeller is mounted on the propeller shaft and the axially extending stems which adjust the pitch of the hub are engaged by a push rod extending through the prop shaft and connected to a double acting cylinder at the opposite end from that at which the rod is connected to the stems.

U.S. Pat. No. 4,973,225, which issued to Kruppa on Nov. 27, 1990, discloses an adjustable propeller. The controllable pitch propeller has a driven rotating hub and adjustable propeller blades positioned therefrom. An adjustment device is provided which has an adjustment ring that can move axially and which has adjustment bars attached to it for adjustment of the propeller blades. At least one continuous waste gas channel is positioned in the hub. In order to relieve the hub of external adjustment forces, the adjustment ring is constructed as a cylinder piston which is movably axially positioned in a cylinder chamber of the hub which can be acted upon hydraulically on both sides.

U.S. Pat. No. 5,017,090, which issued to Morrison on May 21, 1991, describes variable pitch blades and a mechanism for driving them. A propeller blade is provided with a planer configuration, an inner end portion, an outer end portion, a relative sharp outwardly swept back leading edge portion, and a cylindrical stub axially aligned with the plane of the blade and affixed to the inner end portion of the blade. A mechanism enables the pitch of the blades to be adjusted by the operator through a continuum of positions ranging from fast forward to fast reverse so that the boat can be operated at a full range and variety of speeds and can be stopped rapidly. It can also be maneuvered with precision. The mechanism can be used for operating flat-bottom boats in swamps, shallow water, bayous, lakes, rivers and the like, and pass through wet mud and swampy marshes choked with mud or vegetation without excessively fouling the propellers. The mechanism can be serviced and repaired easily and quickly and can be employed to operate small craft such as mud boats with a minimum loss of interior boat space.

U.S. Pat. No. 4,929,201, which issued to Pitt on May 29, 1990, describes a variable pitch marine propeller system. The propeller comprises two removable symmetrical propeller blades with cylindrical bases each having a drive lug attached proximate the driving edge of the point of attachment of each blade. A coupling is associated with the drive lugs of the bases and structured to hold the blades by the bases to align and simultaneously rotate the pitch of the blades in equal and opposite directions in response to movement of the coupling. A hub sub-assembly encases the coupling and bases of the blades to allow the blades to pivot and assume a forward or rearward pitch. The hub sub-assembly has a front end and a rear end capable of mounting on a drive shaft. A spring is associated with the coupling to initially position the coupling in a position which holds the blades in a rear pitch configuration. A hydraulic piston system is associated with the coupling means to provide a predetermined fixed pressure on the coupling to alter the space pressure and move the coupling to a position which causes the blades to assume the desired forward or rearward blade pitch.

U.S. Pat. No. 4,540,341, which issued to Wuhrer on Sep. 10, 1985, discloses an adjustable propeller for marine vessel drive applications. The propeller has an adjusting mechanism for adjusting the pitch of the individual propeller blades. The mechanism comprises an actuator and a correction mechanism for each propeller blade for cyclically adjusting the pitch angle of a related propeller blade under the control of a control device.

U.S. Pat. No. 5,733,156, which issued to Aihara et al on Mar. 31, 1998, discloses a variable propeller for a boat. Variable diameter main blades and stationary subsidiary blades are mounted on a propeller boss in order to provide further enhanced low-speed diving properties and high-speed and high-output performance. When the main blades are in closed positions in which the propeller diameter assumes a minimum value, the main and subsidiary blades are axially superposed on each other. When the main blades are in opened positions in which the propeller diameter assumes a maximum value, the main and subsidiary blades are arranged in a relation such that their blade surfaces are substantially in line with each other.

U.S. Pat. No. 4,297,079, which issued to Marshall on Oct. 27, 1981, describes a variable pitch marine propeller which has a plurality of circumferentially spaced blades mounted on axles at the root portion of the blades in a hub to permit independent movement of each of the blades about an axis of rotation which is substantially parallel to the axis of the hub. The blades can move between a first nested position adjacent the hub and a second extended position. Each of the blades includes leading and trailing striking surfaces or root segments on the root portion of the blades which are hub engageable upon initial rotation of the blade in either direction. Intermediate the leading and trailing segments of the blades are positioned cushioning means which may be mounted in either the hub or the blade root segments for inhibiting the shock of engagement of the blades and the hub upon initial start up of rotation of the hub or upon a sudden reversal of rotation of the hub. The cushioning means includes water entrance and graduated exit means with means to capture water therein to act as a shock absorber for the blades against the hub.

U.S. Pat. No. 4,150,921, which issued to Wennberg et al on Apr. 24, 1979, describes a marine propeller system with adjustable pitch and axially removable blades. Marine propellers are constructed with a split-hub design, permitting adjustment of the pitch of the blades, and axial removability of the blade. By virtue of the axial removability of the blades, the blades can be removed easily for repair or replacement without increasing the diametrical clearance between the blade tips and a tunnel or nozzle of the type in which propellers are frequently disposed. Also, individual blades can be removed without the necessity of dropping the rudder, which is necessary in many vessels utilizing solid propellers. The blades have their spindles or roots clamped to the hub such that axial adjustment of pitch can be achieved by reducing the clamping force. The hub preferably is formed in two sections, with one section being mounted to or forming part of the propeller shaft and including recesses which partially house the blade spindles or roots. The other section preferably is made up of a plurality of independently removable clamping segments, each of which is formed with a recess which cooperates with a recess in the first section to house a blade spindle and to clamp the spindle in a fixed blade pitch position. By removal of a selected clamping segment, its blade can be removed axially rearwardly without necessitating substantial diametrical clearance at the blade tips. Bolted connections are used between the clamping segments and the first section of the hub so as to facilitate both pitch adjustment and blade removal.

All the patents described above are hereby explicitly incorporated in this description by reference.

Propellers which are adjustable or variable often require significant complexity of the associated mechanism. As a result, the cost of the adjustable propeller is often much higher than the cost of a similar propeller which is not adjustable. It would therefore be significantly beneficial if an adjustable propeller could be provided which relies on a simple mechanism that allows an operator to manually change the pitch of the blades in a manner which is accurate and repeatable.

SUMMARY OF THE INVENTION

A propeller made in accordance with the present invention comprises a hub portion which is attachable to a rotatable shaft of a marine propulsion device. The hub portion has at least a first propeller receptacle formed thereon. A preferred embodiment of the present invention further comprises a first propeller blade having a base portion which is attachable to the first propeller receptacle. The first propeller receptacle has a first plurality of alignment devices and the base portion of the first propeller blade has a second plurality of alignment devices. The first one of the second plurality of alignment devices on the base of the blade is alignable with the first one of the first plurality alignment devices on the hub to define a first pitch position of the first propeller blade. The second one of the second plurality of alignment devices on the base of the blade is alignable with a second one of the first plurality of alignment devices on the hub to define a second pitch position of the blade. The first and second pitch positions are distinct from each other.

A preferred embodiment of the present invention further comprises a second propeller receptacle and a third receptacle. The first, second, and third propeller receptacles are identically configured and spaced around a periphery of the hub portion of the propeller. The propeller of the present invention can further comprise a second propeller blade and a third propeller blade. The first, second, and third propeller blades are identically configured and attached to associated ones of the first, second, and third propeller receptacles.

The hub portion of the propeller can be generally cylindrical and the first propeller receptacle can comprise a planer surface which is generally perpendicular to a radius of the generally cylindrical hub portion.

The first plurality of alignment devices can be a plurality of holes extending into the hub portion of the propeller. Each of these holes can be a tapped hole which is threaded to receive a bolt. Alternatively, each of the second plurality of alignment devices can be a hole extending into the base portion of the first propeller blade and the hole can be tapped to receive a bolt. In other words, a bolt can be used to attach the base of the blade to the hub by passing the bolt through the base of the propeller blade and then threading it into the hub or, alternatively, by passing the bolt through a hole through the hub and then threading the bolt into a tapped hole in the base of the propeller blade. Both of these options are within the scope of the present invention. Alternatively, the alignment devices can comprise depressions or holes in either the hub or the base of the propeller and protrusions extending from the other component. The protrusions can be positioned to fit into selected ones of the depressions or holes in such a way that specific pitch angles for the blade can be determined through the selection of the appropriate first and second alignment devices. The separate bolting system can then be used to physically hold the base of the propeller in attachment with the hub.

The hub portion of the propeller can comprise a receptacle which, in turn, comprises an opening formed through a thickness in the hub portion. The base portion of the blade can then comprise an extension which is shaped to be received in the opening. Both the opening and the extension can be cylindrical in cross-section. A protuberance can then be attached to the extension in order to limit removal of the propeller blade from the hub and require that the relative positions of the propeller blade and hub match one or more alternative configurations. In other words, to remove the propeller base from the hub, it can be made necessary to align the protuberance with a slot formed in the wall of the opening in order to permit the propeller blade to be removed radially away from the hub. This serves the valuable function of retaining the blade in attachment with the hub even when no bolt maintains the rigid attachment of these two components together. This is particularly useful when changing the pitch of a blade and allows an operator to remove a bolt and change the pitch by replacing the bolt in an alternative hole while the propeller remains in loose contact with the hub. The means by which the propeller is retained in loose contact with the hub is not limiting to the present invention buy, instead, can be configured in many alternative forms.

BRIEF DESCRIPTION OF THE DRAWINGS

The present invention will be more fully and completely understood of a reading of the description of the preferred embodiment in conjunction with the drawings, in which.

DESCRIPTION OF THE PREFERRED EMBODIMENT

Figure 1:
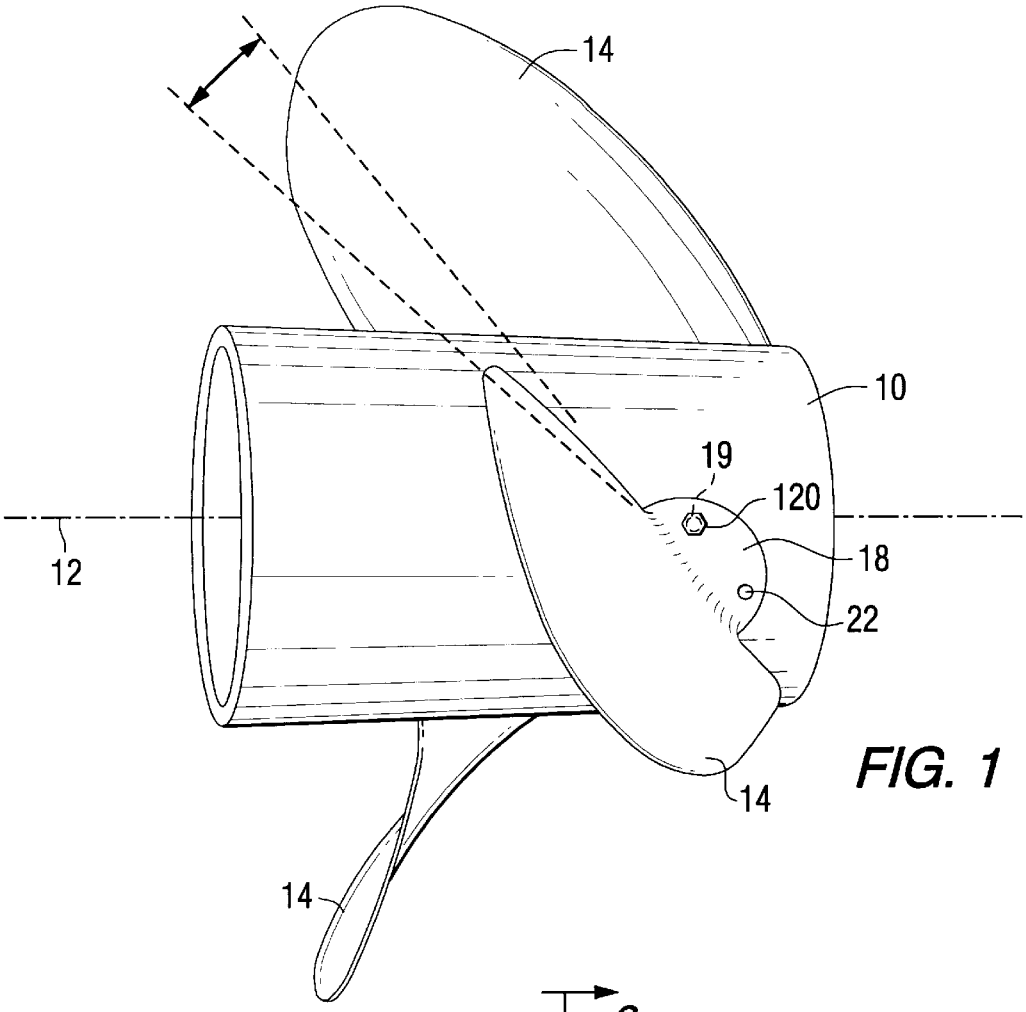
FIG. 1 is a perspective view of the present invention.

Throughout the description of the preferred embodiment, like components will be identified by like reference numerals.

FIG. 1 illustrates a propeller made in accordance with the principles of the present invention. The propeller comprises a hub portion 10 which is attachable to a rotatable shaft of the marine propulsion device. The propeller shaft (not shown in FIG. 1) and the propeller hub 10 rotate about axis 12. The propeller also comprises a plurality of propeller blades 14 which each have a base portion 18 which is attachable to a propeller receptacle (not shown in FIG. 1). The propeller receptacle, which is hidden from view under the base 18 in FIG. 1, has a first plurality of alignment devices and the base portion 18 of the propeller has a second plurality of alignment devices. In FIG. 1, two of the alignment devices can be seen. The alignment devices in the embodiment illustrated in FIG. 1 are holes extending through the base portion 18. One hole 19 has a bolt 120 extending through it and the other hole 22 does not. Each of the second plurality of alignment devices (e.g. holes 19 and 22) is alignable with one of the first plurality of alignment devices in the receptacle.

With continued reference to FIG. 1, it should be understood that each of the propeller blade base portions 18 are provided with a second plurality of alignment devices, such as the holes, which are shaped and positioned to provide appropriate alignment with the first plurality of alignment devices of the receptacles.

Figure 2:
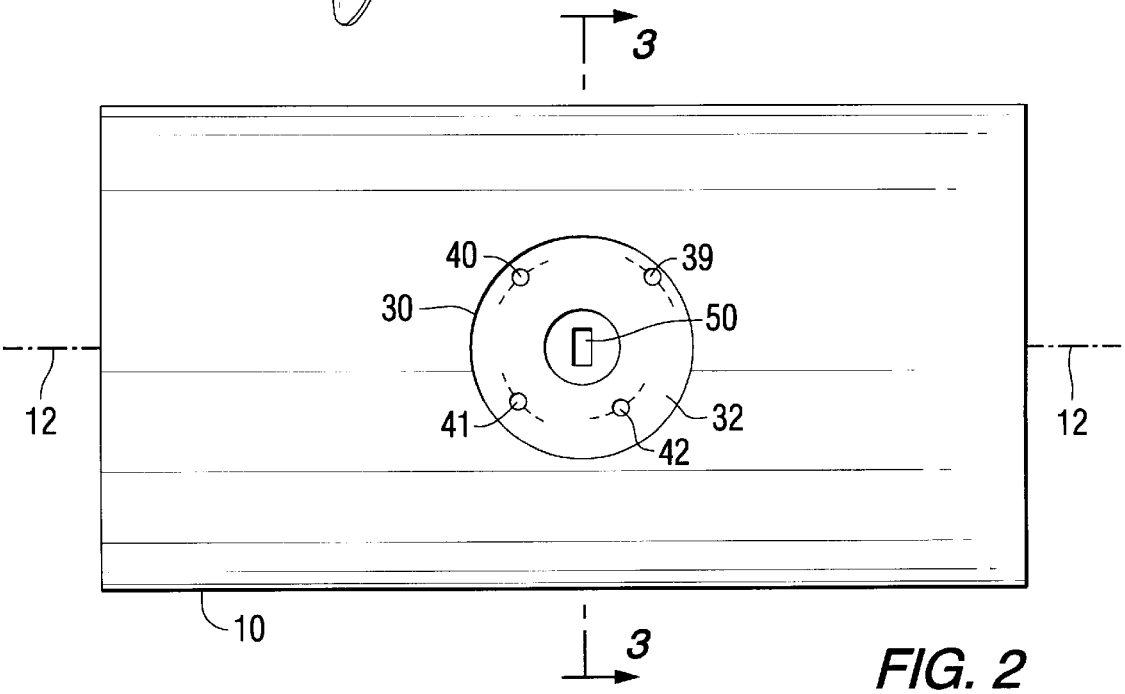
FIG. 2 shows a receptacle formed in the hub of a propeller made in accordance with the present invention.

FIG. 2 shows the propeller hub 10 with the blades removed to expose one of the receptacles 30. The receptacle 30 shown in FIG. 2 comprises a generally planer surface 32 which is generally perpendicular to a radius of the generally cylindrical hub portion 12 which, in turn, is perpendicular to axis 12. The receptacle 30 has four alignment devices, 39–42. These alignment devices in the embodiment shown in FIG. 2 are holes extending into the wall thickness of the cylindrical hub 10. The holes are threaded to receive a bolt which passes through an associated hole in the propeller base portion 18 described above in conjunction with FIG. 1.

In FIG. 2, it should be noted that each of the alignment devices, 39, 40, 41, and 42, are located on bolt circles of different diameters. This is done intentionally to prevent the possibility of any one of the alignment devices in the base portion 18 of the propeller blade 14 being inadvertently aligned with an improper one the alignment devices, 39–42, of the receptacle 30.

In the embodiment of the present invention shown in FIG. 2, it can be seen that a generally rectangular slot 50 is located in the central region of the receptacle 30 and extends through the wall thickness of the hub portion 10. The function of the generally rectangular slot 50 will be described in greater detail below.

Figure 3:
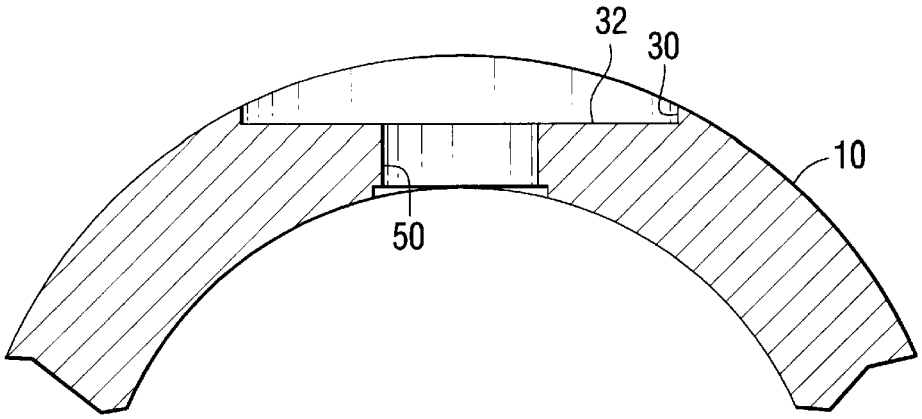
FIG. 3 is a section view of FIG. 2.

FIG. 3 is a partial section view of the hub portion 10 shown in FIG. 2. The section view of FIG. 3 shows the generally planer surface 32 into which the alignment devices, 39–42, are formed. The slot 50 is also shown in FIG. 3. It should be understood that, although many different types of arrangements can be used in accord with the present invention, the slot 50 provides one possible means for locking a propeller blade on the hub 10 while the base portion 18 of the propeller blade is disposed within the receptacle 30.

Figure 4:
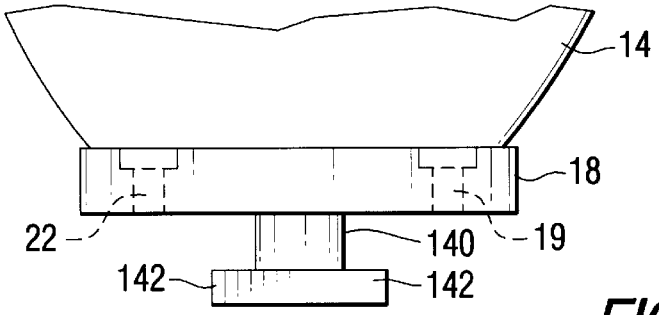
FIG. 4 shows the base portion of a propeller made to be assembled with the receptacle shown in FIG. 3.

FIG. 4 shows the base portion 18 with a portion of the propeller blade 14 attached to it. From the base portion 18, the extension 140 extends in a direction away from the blade 14. The extension 40 is shaped to be received through the slot 50 described above in conjunction with FIGS. 2 and 3. One or more protuberances 42 extend from the extension 140 and allow the blade to be locked in position. This can be accomplished by inserting the extension 140 and the protuberances 42 through slot 50 and then turning the base portion 18 in such a way that the protuberances 42 inhibit removal of the blade from the receptacle 30. However, it should be clearly understood that the particular shape and size of the extension 140 and the protuberances 42 are not limiting to the scope of the present invention. Instead, many different techniques are known to those skilled in the art for aligning one component with another and preventing easy removal of the components from each other.

Figure 5:
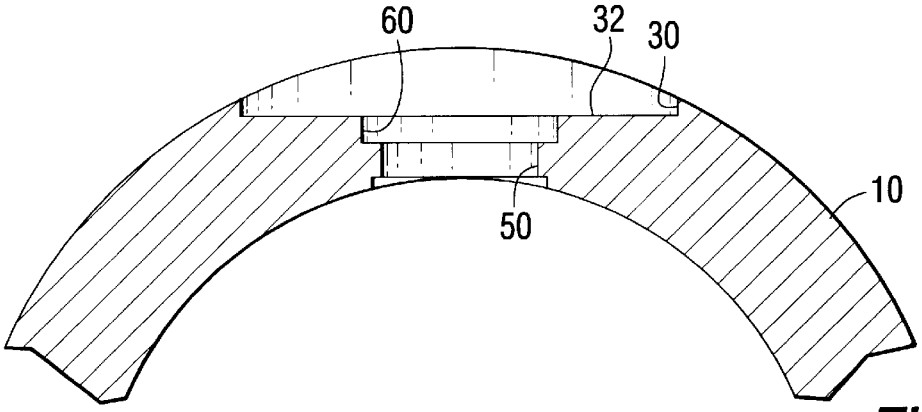
FIG. 5 is an alternative configuration of the receptacle shown in FIG. 3.
Figure 6:
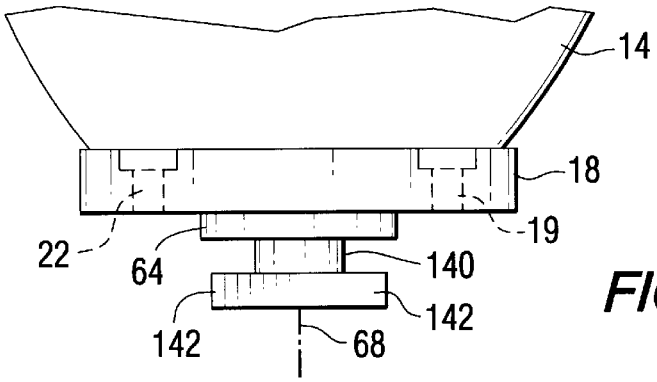
FIG. 6 shows a propeller base portion shaped to be associated with the receptacle of FIG. 5.

FIG. 5 is generally similar to FIG. 3, but the receptacle 30 is provided with a counter bore 60 that serves to align the base portion 18 of the blade with the receptacle 30. FIG. 6 shows the base portion 18 of a propeller blade 14. It also shows the extension 140 with the protuberances 42. In addition, a machined boss 64 is formed on the base portion 18 in order to be inserted into the counter bore 60 of the hole 10. The machined surface of the boss 64 is generally cylindrical and coaxial with axis 68. The boss 64, after being inserted into the counter bore 60, allows the blade 14 and its base portion 18 to be easily rotated about axis 68 to facilitate the procedure of aligning a pre-selected alignment device of the base portion 18 with an associated alignment device formed in the planer surface 32 of the receptacle 30.

With reference to FIGS. 4 and 6, it can be seen that two holes, 19 and 22, are formed through the thickness of the base portion 18. These holes are shown as having counter bores to accept the head of a bolt. In a typical application of a preferred embodiment of the present invention, a bolt would be inserted downward through the base portion 18 of the propeller blade and threaded into an associated tapped hole in the planer surface 32 of the receptacle 30. However, it should be understood that an alternative embodiment of the present invention could provide a hole through the thickness of the hub 10 which is shaped to receive a bolt extended therethrough. That bolt could then be threaded into a tapped hole in the base portion 18 of the propeller blade. Either of these two alternative embodiments is within the scope of the present invention.

Figure 7:
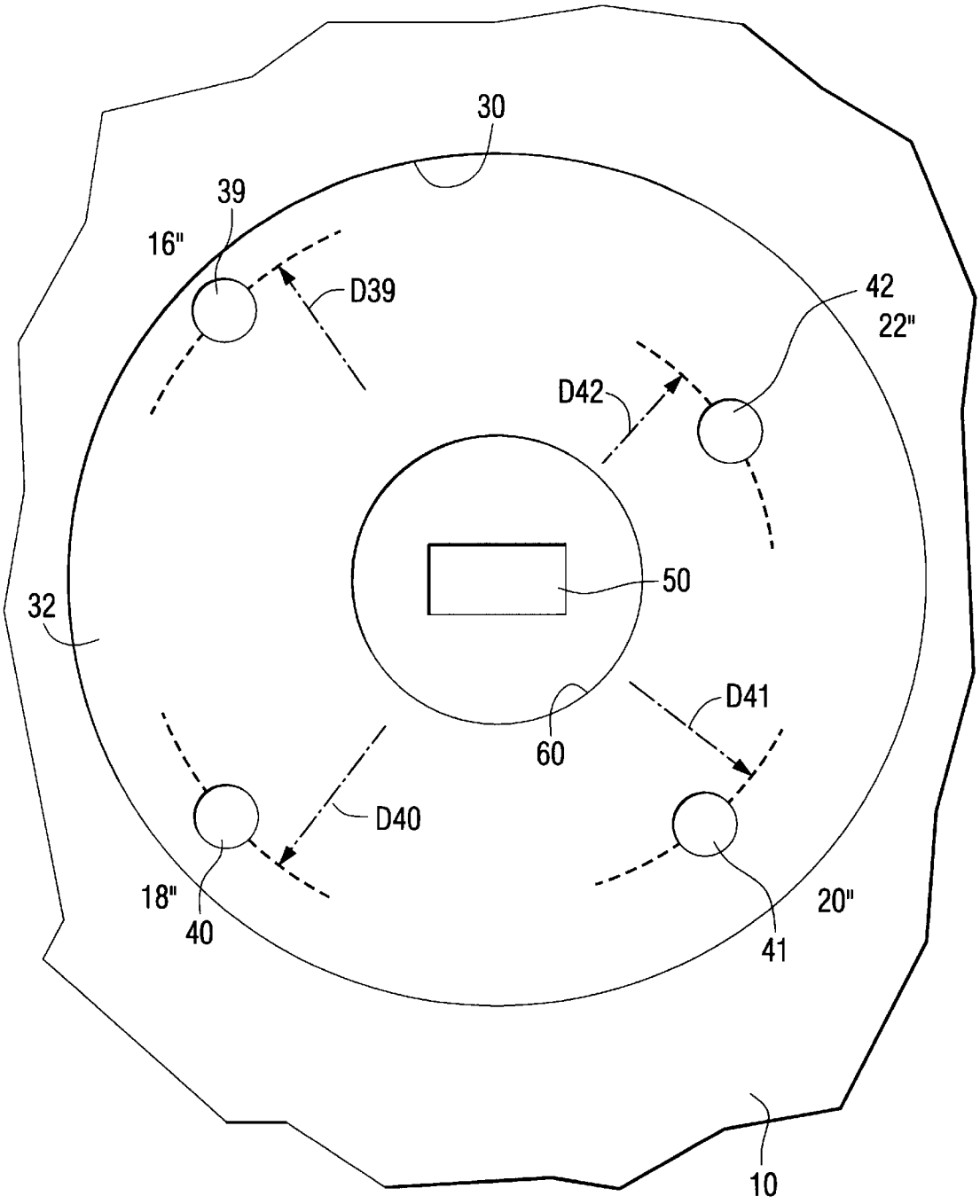
FIG. 7 shows a view of a receptacle, with various bolt circles illustrated.

FIG. 7 shows an enlarged view of the receptacle 30 described above in conjunction with FIG. 2. In FIG. 7, the four holes, 39–42, are shown located at various positions of the receptacle 30. They extend through, or at least into, the thickness of the hub 10 and are tapped in a preferred embodiment of the present invention. Each of the holes which serve as a first plurality of alignment devices in the preferred alignment of the present invention, are arranged to be on a distinct bolt circle from the others. In other words, hole 39 is located on a bolt circle of diameter D39, hole 40 is on bolt circle D40, hole 41 is on bolt circle D41 and hole 42 is on bolt circle D42. Diameter D39 is greater than the other three bolt circle diameters. None of the four bolt circle diameters shown in FIG. 7 are precisely equal to another bolt circle. As will be described in greater detail below, the base portion 18 of the propeller blade 14 is also provided with the four bolt circles in which each of the bolt circles of the base portion 18 is generally identical with one of the bolt circles of holes 39–42 shown in FIG. 7.

Figure 8:
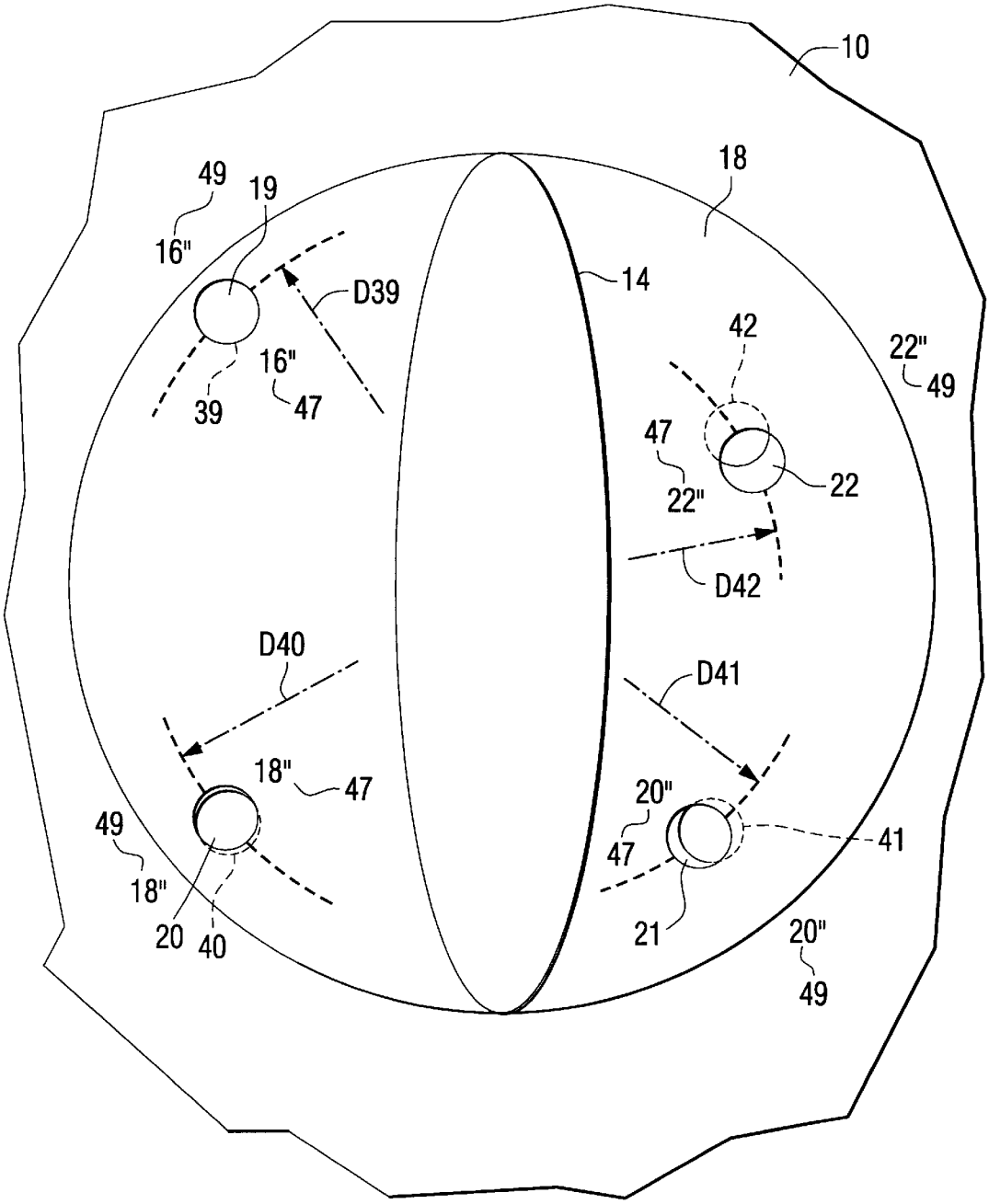
FIG. 8 shows a base portion of a propeller associated with a receptacle of a hub.

FIG. 8 shows the base portion 18 of propeller blade 14 disposed in a receptacle 30 of the hub 10. The locations of holes 19–22 are shown extending through the base portion 18. By dashed lines, the locations of holes 39–42 of the receptacle 30 are also shown, but it should be clearly understood that the locations of holes 39–42 are beneath the base portion 18 and extend through the planer surface 32 of the receptacle 30. Each hole through the base portion 18 is matched with an associated hole in the planer surface 32. In other words, hole 19 in the base portion 18 is shaped to match hole 39 in the planer surface 32 of the receptacle in size and location on the bolt circle of diameter D39. In a typical application of the present invention, hole 19 is a clearance hole to accept a bolt which can then be threaded into tapped hole 39 in the receptacle. The same relative characteristics are provided by the other pairs of holes through the base portion 18 of the propeller and the receptacle 30. In FIG. 8, hole 19 is aligned with hole 39 in such a way that a bolt can be inserted through hole 19 and threaded into hole 39. When a bolt is used to attach a base portion 18 to the receptacle 30 by passing through hole 19 and being threaded into hole 39, the precise location of the blade 14 is determined and fixed. If the bolt is removed from holes 19 and 39 and the base portion is rotated slightly in a counterclockwise direction, hole 20 will eventually align with hole 40. This requires a slight rotation of the base portion 18. When holes 20 and 40 are aligned to permit the bolt to be passed through hole 20 and threaded into hole 40, the blade 14 will be aligned at a different pitch relative to the hub 10 then the pitch of the blade when holes 19 and 39 were aligned. Extending the bolt through hole 20 and threading the bolt into hole 40 will lock the blade in the second pitch position. Similarly, by removing the bolt from hole 20 and rotating the base portion 20 slightly in a counterclockwise direction, hole 21 will align with hole 41 and the bolt can be used to lock the base portion 18 in this third selected pitch position. If the bolt is removed and the base portion 18 is further rotated to align holes 22 and 42, the bolt can then be inserted through hole 22 and threaded into hole 42 in order to lock the propeller blade in a fourth pitch position.

As can be seen from the above description, the location of the holes, 19–22, of the base portion 18 and the holes, 39–42, of the receptacle 30 in the manner described above facilitates the selection of the pitch positions. In the example described above, only one of the holes of the base portion 18 can be aligned with an associated hole in the receptacle 30 at any particular time. If one hole is appropriately aligned with its associated hole, none of the other holes in the base portion can be aligned with their associated holes in the receptacle. Similarly, only one hole in the receptacle can be aligned with any particular hole in the base portion. This arrangement makes the present invention relatively error free in selecting a pitch for the propeller and for adjusting the propeller blades to match that selected pitch. Naturally, in a preferred embodiment of the present invention, is it would be significantly beneficial if the pitch number 47 is also marked on the base portion 18 of the propeller. In addition, the pitch 49 can be marked on the hub near its associated tapped hole. By selecting the proper holes, which are identified by their pitch numbers, 47 and 49, the operator can select the hole of the base portion 18 that is marked with the selected pitch position and align that selected hole with the hole in the hub that is similarly marked with the selected pitch position. Then, a slight rotation of the base portion 18 will allow the operator to insert a bolt through the selected hole and thread the bolt into its associated tapped hole in the hub 10. This procedure significantly facilitates the process of changing pitch positions of the blades. Furthermore, since only one hole in the base portion 18 can match an associated hole in the receptacle 30, the procedure is very simple. Furthermore, it is virtually error proof. The only cautionary step that the operator is required to make is to assure that each of the blades on the propeller hub is properly attached to the hub to result in a pitch selection that matches all of the other blades.

Figure 9:
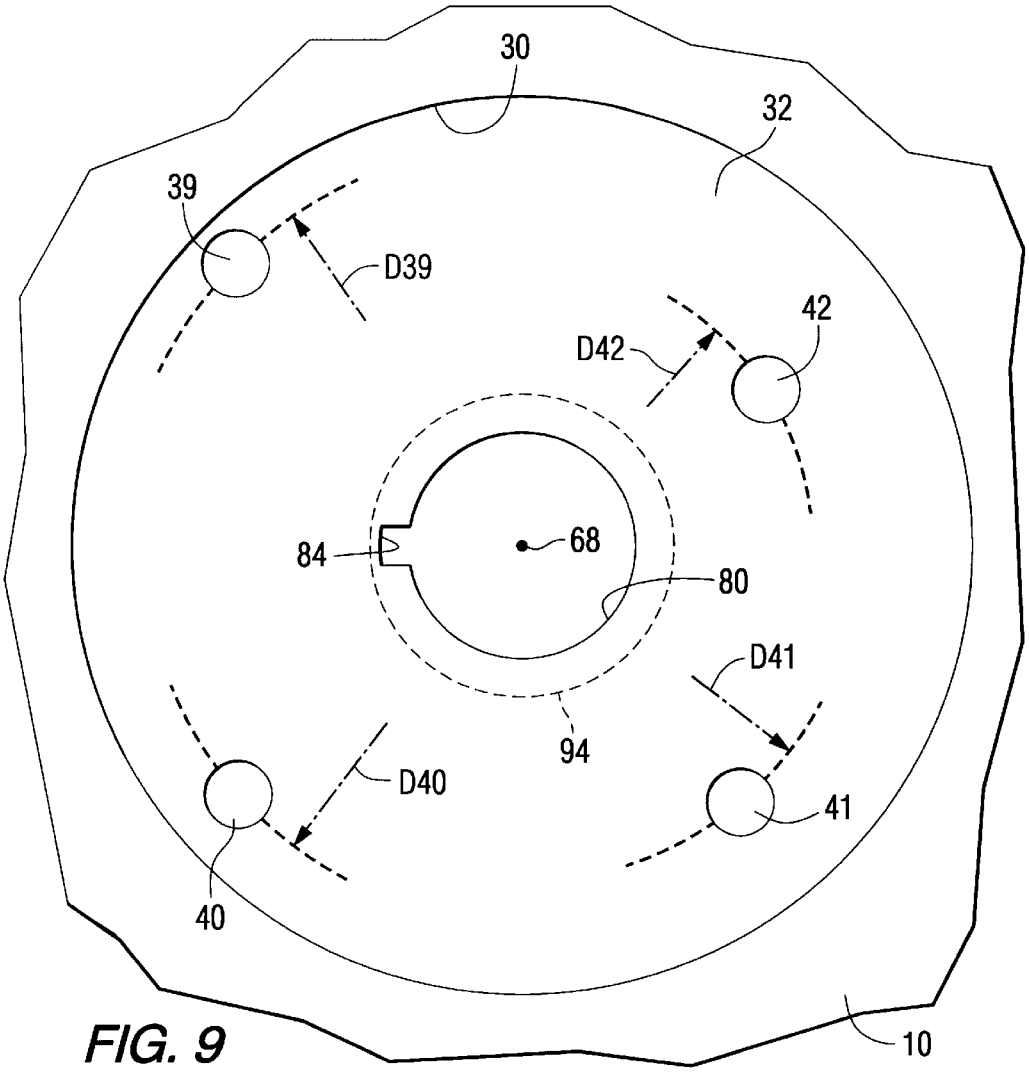
FIG. 9 shows an alternative configuration of a receptacle.
Figure 10:
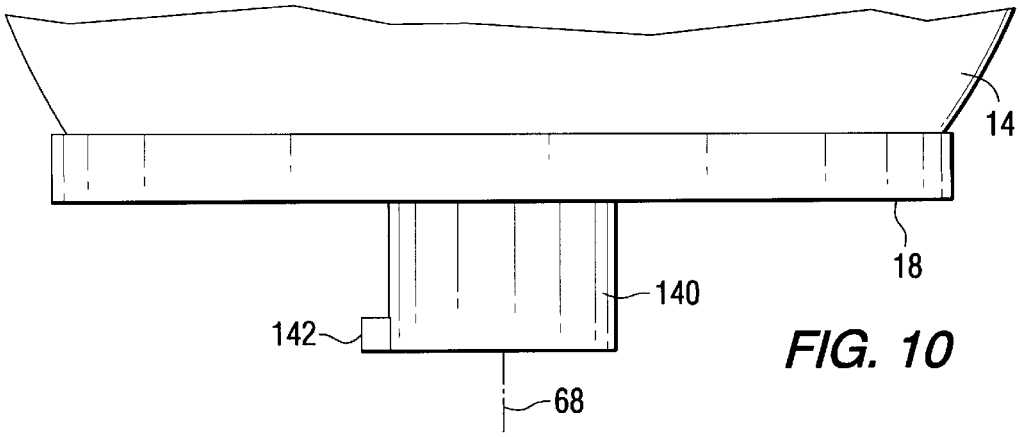
FIG. 10 shows a blade base portion shaped to be associated with the receptacle of FIG. 9.

FIG. 9 shows the receptacle 30 and its planer surface 32 with the four alignment devices, or holes, extending into the thickness of the hub 10. The embodiment shown in FIG. 9 differs from the embodiment shown in FIG. 7 by the shape of the opening 80 which serves the function of the counter bore 60, but extends through the entire thickness of the hub 10. A slot 84 also extends through the thickness of the hub 10 to allow passage of a protuberance formed on the extension of the base portion 18. The extension 140 shown in FIG. 10 is provided with a protuberance 142 extending from its outer cylindrical surface. The outer surface of extension 140 in FIG. 10 is shaped to be received in sliding relation within the opening 80 shown in FIG. 9. The protuberance 142 slides in clearance relation through slot 84 when the base portion 18 is moved downward against the planer surface 32 of the receptacle 30 as the extension 140 slides into opening 80.

With reference to FIGS. 9 and 10, the assembly of the blade 14 to the hub 10 comprises the steps of aligning the protuberance 142 with slot 84 and the extension 140 with opening 80. Then the base portion 18 is moved toward the planer surface 32. After the base portion 18 is moved downward against the planer surface 32, the blade can then be rotated about axis 68 to move the protuberance 142 away from slot 84. In FIG. 9, dashed line 94 represents a generally annular groove formed around the radially inward end of opening 80 to allow the protuberance 142 to rotate completely around the opening 80. This allows the blade 14 to be positioned at any angle relative to the hub 10 and, in addition, it allows any of the holes, 19–22, to be aligned with its associated hole 39–42.

The protuberance 142 provides another advantage to the present invention. When the bolt is removed from the two aligned holes, the protuberance will prevent the blade 14 from being removed from the hub 10 unless it is perfectly aligned with slot 84. This allows the operator to remove the bolt and change the pitch setting without allowing the blade to accidentally fall away from the hub 10. Naturally, it is advantageous if the groove 84 is positioned at a location that is remote from the operative position of the protuberance 142 when the blade is in its most likely position for usage.

Figure 11:
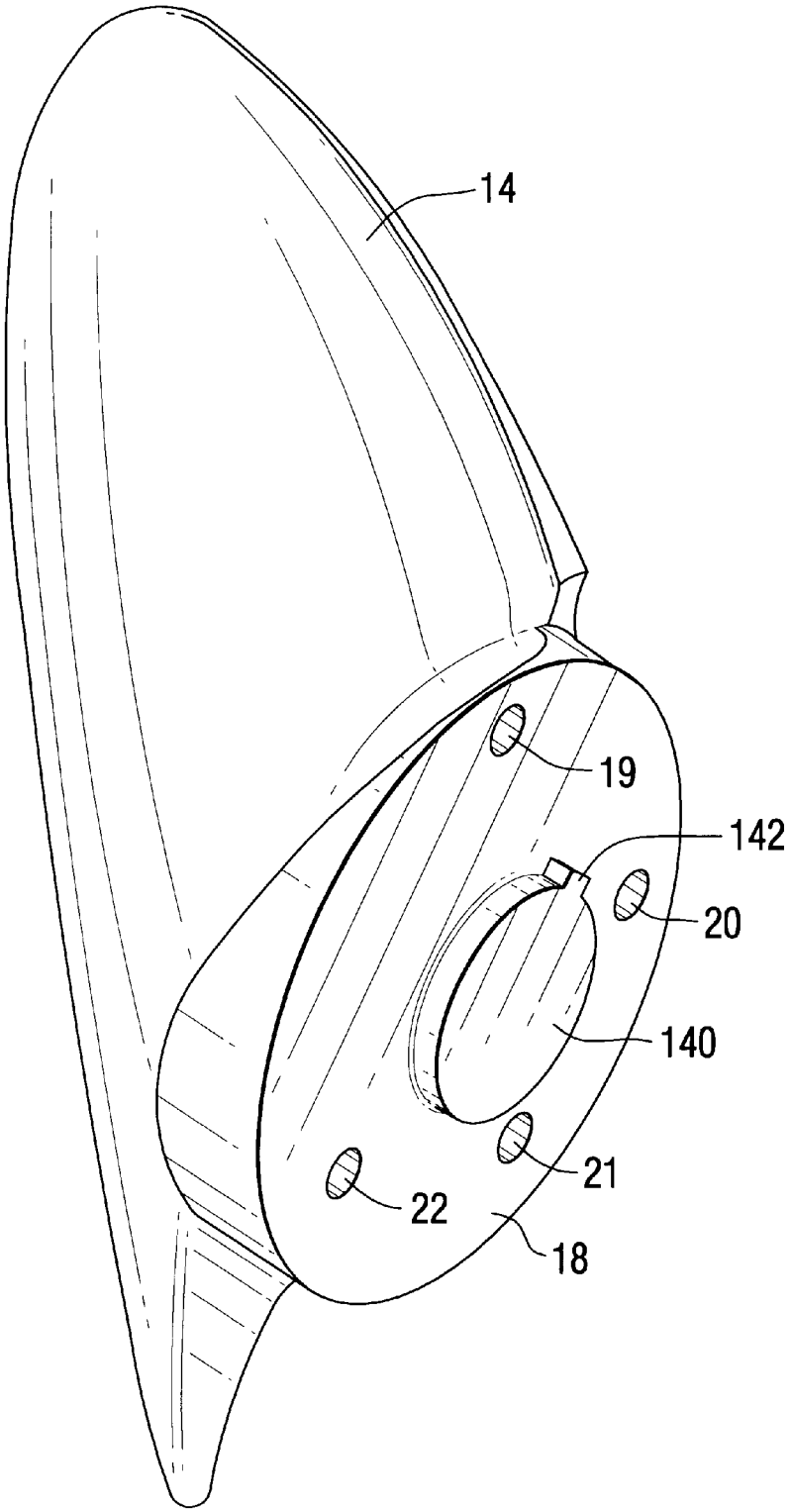
FIGS. 11 and 12 show two perspective views of a blade and base portion made in accordance with the present invention.
Figure 12:
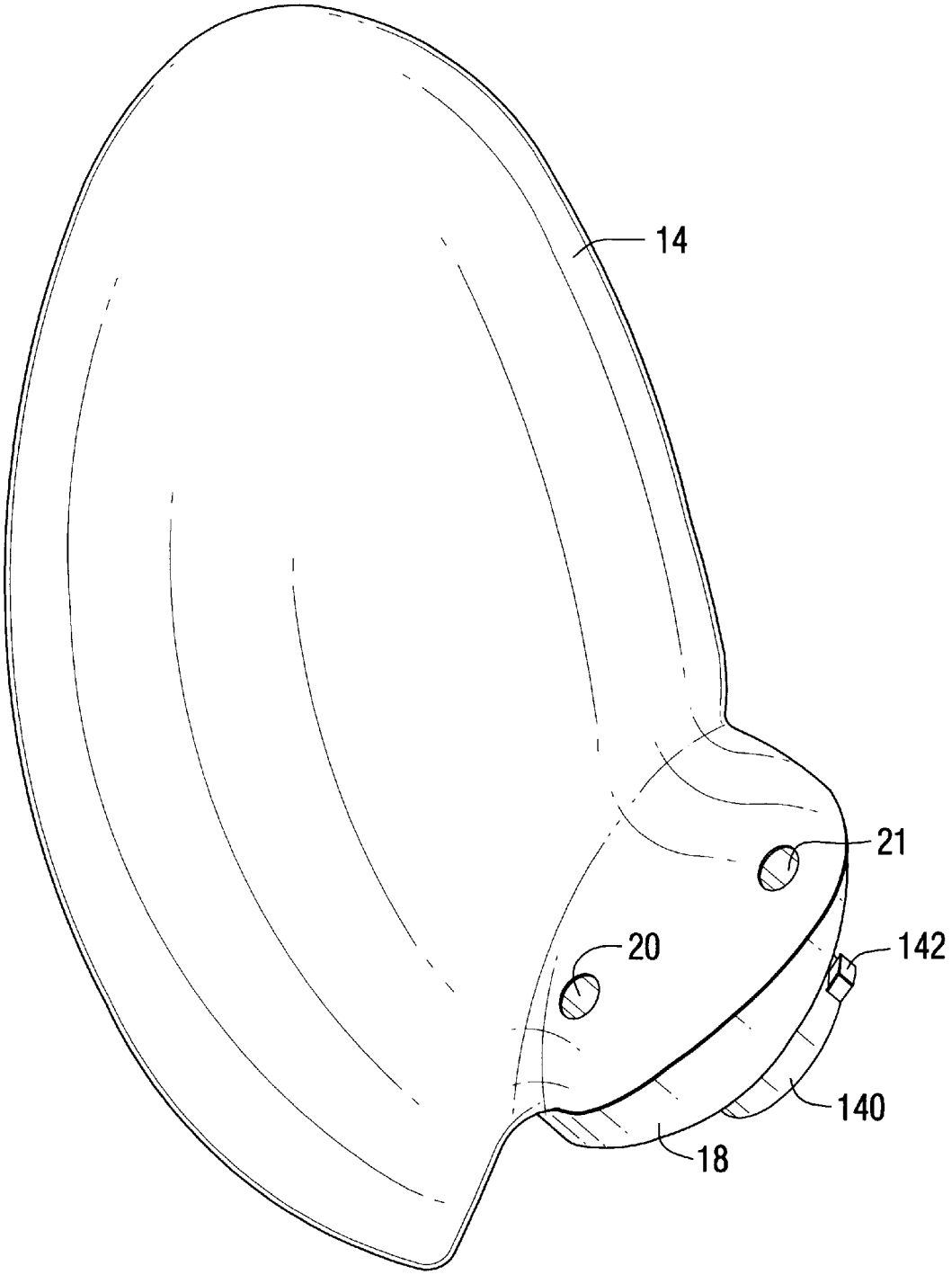

FIGS. 11 and 12 show two perspective views of the blade 14 and the base portion 18. As can be seen, holes 19–22 extend through the base portion 18 and allow a bolt to be extended through the pre-selected one of the holes and threaded into an associated hole in the blade receptacle. The extension 140 extends from the base portion 18 in a direction away from the blade and protuberance 142 extends from the cylindrical surface of the extension 140. As described in detail above, extension 140 facilitates the rotation of the blade relative to the receptacle 30 until a bolt is used to affix it in one selected location and pitch positions.

Although several embodiments of the present invention are described above, it should be understood that alternative embodiments are also within the scope of the present invention. For example, the particular size and shape of the extension 140 and the protuberance 142 are not limiting to the present invention. In fact, although it is preferable and provides a significant advantage, it is not absolutely necessary to provide a means for preventing removal of the blade from the hub unless a protuberance or similar structure is aligned perfectly with a slot in the hub. The advantages of the present invention is achieved from its use of a plurality of alignment devices with a second plurality of alignment devices on the hub so that accurate location of the blade can be selected for a preferred pitch position. The system provided by the present invention to assure accurate location of the blade in a selected pitch position is simple and error proof. It is also exact because the appropriate selection of the alignment holes provides a pre-selected pitch position without any need for the operator to follow a more rigorous and difficult procedure.

I claim:

1. An adjustable propeller, comprising:

a hub portion which is attachable to a rotatable shaft of a marine propulsion device, said hub portion having a first propeller receptacle formed thereon;

a first propeller blade having a base portion which is attachable to said first propeller receptacle, said first propeller receptacle having a first plurality of alignment devices, said base portion having a second plurality of alignment devices, a first one of said second plurality of alignment devices being alignable with a first one of said first plurality of alignment devices to define a first pitch position of said first propeller blade, a second one of said second plurality of alignment devices being alignable with a second one of said first plurality of alignment devices to define a second pitch position of said first propeller blade, said first and second pitch positions being distinct from each other;

an opening formed through a thickness of said hub portion; and said base portion of said first propeller blade comprises an extension which is shaped to be received in said opening; and a protuberance attached to said extension to limit removal of said first propeller blade from said hub portion and require the relative position of said propeller blade and said hub portion to match one or more alternative configurations.

2. The propeller of claim 1, further comprising:

a second propeller receptacle and a third propeller receptacle, said first, second, and third propeller receptacles being identically configured and spaced around a periphery of said hub portion.

3. The propeller of claim 2, further comprising:

a second propeller blade and a third propeller blade, said first, second, and third propeller blades being identically configured and attached to associated ones of said first, second, and third propeller receptacles.

4. The propeller of claim 1, wherein:

said hub portion is generally cylindrical.

5. The propeller of claim 4, wherein:

said first propeller receptacle comprises a planar surface which is generally perpendicular to a radius of said generally cylindrical hub portion.

6. The propeller of claim 1, wherein:

each of said first plurality of alignment devices is a hole extending into said hub portion.

7. The propeller of claim 6, wherein:

each of said first plurality of alignment devices is a tapped hole which is threaded to receive a bolt.

8. The propeller of claim 6, wherein:

each of said second plurality of alignment devices is a hole extending into said base portion of said first propeller blade.

9. The propeller of claim 8, wherein:

each of said second plurality of alignment devices is a tapped hole which is threaded to receive a bolt.

10. The propeller of claim 1, wherein:

said first plurality of alignment devices comprises four alignment devices; and said second plurality of alignment devices comprises four alignment devices.

11. An adjustable propeller, comprising:

a generally cylindrical hub portion which is attachable to a rotatable shaft of a marine propulsion device, said hub portion having a first propeller receptacle formed thereon; and a first propeller blade having a base portion which is attachable to said first propeller receptacle, said first propeller receptacle having a first plurality of alignment devices, said base portion having a second plurality of alignment devices, a first one of said second plurality of alignment devices being alignable with a first one of said first plurality of alignment devices to define a first pitch position of said first propeller blade, a second one of said second plurality of alignment devices being alignable with a second one of said first plurality of alignment devices to define a second pitch position of said first propeller blade, said first and second pitch positions being distinct from each other, said first propeller receptacle comprising a planar surface which is generally perpendicular to a radius of said generally cylindrical hub portion, each of said second plurality of alignment devices being a tapped hole which is threaded to receive a bolt.

12. The propeller of claim 11, further comprising:

a second propeller receptacle and a third propeller receptacle, said first, second, and third propeller receptacles being identically configured and spaced around a periphery of said hub portion; and a second propeller blade and a third propeller blade, said first, second, and third propeller blades being identically configured and attached to associated ones of said first, second, and third propeller receptacles.

13. The propeller of claim 11, wherein:

said propeller receptacle comprises an opening formed through a thickness of said hub portion; and said base portion of said first propeller blade comprises an extension which is shaped to be received in said opening.

14. The propeller of claim 13, further comprising:

a protuberance attached to said extension to limit removal of said first propeller blade from said hub portion and require the relative position of said propeller blade and said hub portion to match one or more alternative configurations.

15. An adjustable propeller, comprising:

a first propeller blade; and a base portion attached to said first propeller blade, said base portion being attachable to a first propeller receptacle formed on a hub portion of said adjustable propeller, said first propeller receptacle having a first plurality of alignment devices, said base portion having a second plurality of alignment devices, a first one of said second plurality of alignment devices being alignable with a first one of said first plurality of alignment devices to define a first pitch position of said first propeller blade, a second one of said second plurality of alignment devices being alignable with a second one of said first plurality of alignment devices to define a second pitch position of said first propeller blade, said first and second pitch positions being distinct from each other, said second ones of said first and second plurality of alignment devices being nonaligned with each other when said first ones of said first and second plurality of alignment devices are aligned, said first ones of said first and second plurality of alignment devices being nonaligned with each other when said second ones of said first and second plurality of alignment devices are aligned, each of said first plurality of alignment devices being disposed at a different distance from a rotational axis of said first propeller blade with respect to said base portion.

16. The adjustable propeller of claim 15, wherein:

each of said first plurality of alignment devices is a hole extending into said hub portion; and each of said first plurality of alignment devices is a tapped hole which is threaded to receive a bolt.

17. The adjustable propeller of claim 15, further comprising:

an opening formed through a thickness of said hub portion; and an extension of said base portion of said first propeller blade which is shaped is to be received in said opening; and a protuberance attached to said extension to limit removal of said first propeller blade from said hub portion and require the relative position of said propeller blade and said hub portion to match one or more alternative configurations.

* * * * *